US007337486B2

(12) United States Patent
Tsuda et al.

(10) Patent No.: US 7,337,486 B2
(45) Date of Patent: Mar. 4, 2008

(54) HAND TOOL

(75) Inventors: Hollan Akio Tsuda, Portland, OR (US); Nathan E. Knight, Portland, OR (US); Melissa C. Yale, Portland, OR (US); Charles F. Goodrich, III, Vancouver, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 11/410,879

(22) Filed: Apr. 25, 2006

(65) Prior Publication Data

US 2007/0245497 A1 Oct. 25, 2007

(51) Int. Cl.
*B26B 11/00* (2006.01)
*B25B 15/00* (2006.01)

(52) U.S. Cl. ..... 7/120; 7/165

(58) Field of Classification Search ..... 7/118–120, 7/165; 30/138
See application file for complete search history.

(56) References Cited

U.S. PATENT DOCUMENTS

| | | | | |
|---|---|---|---|---|
| 187,483 | A | 2/1877 | Rightor | |
| 208,654 | A * | 10/1878 | Waldman et al. | 7/119 |
| 226,910 | A | 4/1880 | Friebertshauser | |
| 345,296 | A | 7/1886 | Friebertshauser | |
| 362,718 | A | 5/1887 | Brueckner | |
| 364,414 | A | 6/1887 | Hollweg | |
| 551,052 | A | 12/1895 | Shonnard | |
| 610,530 | A | 9/1898 | Hammesfahr | |
| 749,230 | A | 1/1904 | Severance | |
| 825,093 | A | 7/1906 | Watson | |
| 927,532 | A * | 7/1909 | Heissenberger | 30/138 |
| 969,909 | A | 9/1910 | Schrade | |
| 1,012,555 | A | 12/1911 | Irick | |
| 1,179,111 | A | 4/1916 | Knowlton | |
| 1,232,886 | A * | 7/1917 | Boston | 7/120 |
| 1,454,665 | A | 5/1923 | Bobek | |
| 1,743,022 | A | 1/1930 | Carman | |
| 1,800,843 | A | 4/1931 | Moulton | |

(Continued)

FOREIGN PATENT DOCUMENTS

EP 0 100 377 A1 2/1984

(Continued)

OTHER PUBLICATIONS

Van Hoy Snap Lock, available at http://www.crkt.com/snaplock.html (Jul. 5, 2006), 2 pages.

(Continued)

*Primary Examiner*—Hadi Shakeri
(74) *Attorney, Agent, or Firm*—Alston & Bird LLP

(57) ABSTRACT

A hand tool is provided that includes a handle and one or more implements that are movable relative to the handle. The hand tool may include a first implement that is rotatable within a plane and a second implement that is slidable along an axis that may also lie within that same plane. The implements may include a variety of tools or blades, such as knife blades and cutting hooks. The hand tool may also include locks and/or catches to bias or lock one or more of the implements in retracted and extended positions. The handle may define a groove or other recess for holding an instrument such as a sharpening tool.

16 Claims, 8 Drawing Sheets

U.S. PATENT DOCUMENTS

| | | | | |
|---|---|---|---|---|
| 1,828,121 | A | 10/1931 | Adam et al. | |
| 1,898,422 | A * | 2/1933 | Champlin | 7/120 |
| 2,250,290 | A | 7/1941 | Berg | |
| 2,263,415 | A | 11/1941 | Berg et al. | |
| 2,327,090 | A * | 8/1943 | Berg | 7/118 |
| 2,597,540 | A | 5/1952 | Smith | |
| 2,718,695 | A | 9/1955 | Elsener | |
| 2,809,384 | A | 10/1957 | Kayser | |
| 3,363,315 | A | 1/1968 | Anderson | |
| 3,832,775 | A | 9/1974 | Stahel, II et al. | |
| 3,875,600 | A | 4/1975 | Reveaux | |
| 3,942,394 | A | 3/1976 | Juranitch | |
| 4,124,939 | A | 11/1978 | Onoue | |
| 4,187,607 | A | 2/1980 | Simuro et al. | |
| 4,238,862 | A | 12/1980 | Leatherman | |
| 4,259,815 | A | 4/1981 | Kuban | |
| 4,342,410 | A | 8/1982 | Sloan | |
| 4,347,665 | A | 9/1982 | Glessner | |
| 4,404,748 | A | 9/1983 | Wiethoff | |
| 4,451,982 | A | 6/1984 | Collins | |
| 4,501,068 | A * | 2/1985 | Palson | 30/138 |
| 4,502,221 | A | 3/1985 | Pittman | |
| 4,512,051 | A | 4/1985 | Magan | |
| 4,563,813 | A | 1/1986 | Fortenberry | |
| 4,570,341 | A | 2/1986 | Konneker | |
| 4,719,700 | A | 1/1988 | Taylor, Jr. | |
| 4,741,106 | A | 5/1988 | Yamagishi | |
| 4,744,272 | A | 5/1988 | Leatherman | |
| 4,759,645 | A | 7/1988 | Kuo | |
| 4,776,094 | A | 10/1988 | Glessner | |
| 4,805,250 | A * | 2/1989 | Dugas | 7/118 |
| 4,805,303 | A | 2/1989 | Gibbs | |
| 4,811,486 | A | 3/1989 | Cunningham | |
| 4,837,932 | A | 6/1989 | Elsener | |
| 4,869,011 | A * | 9/1989 | Whiting et al. | 43/23 |
| 4,882,841 | A * | 11/1989 | Margolis | 7/118 |
| 4,888,869 | A | 12/1989 | Leatherman | |
| 4,896,424 | A | 1/1990 | Walker | |
| 4,947,552 | A | 8/1990 | Barnes | |
| 4,974,323 | A | 12/1990 | Cassady | |
| 4,979,301 | A | 12/1990 | Walker | |
| 5,044,079 | A | 9/1991 | Gibbs | |
| 5,060,379 | A | 10/1991 | Neely | |
| 5,093,994 | A * | 3/1992 | Karas | 30/125 |
| 5,095,624 | A | 3/1992 | Ennis | |
| 5,111,581 | A | 5/1992 | Collins | |
| 5,142,721 | A | 9/1992 | Sessions et al. | |
| 5,210,895 | A * | 5/1993 | Hull et al. | 7/165 |
| 5,245,721 | A | 9/1993 | Lowe et al. | |
| 5,251,353 | A | 10/1993 | Lin | |
| 5,267,366 | A | 12/1993 | Frazer | |
| 5,270,909 | A | 12/1993 | Weiss et al. | |
| 5,280,659 | A | 1/1994 | Park | |
| 5,293,690 | A | 3/1994 | Cassady | |
| 5,331,741 | A | 7/1994 | Taylor, Jr. | |
| 5,349,753 | A | 9/1994 | Gaffney | |
| 5,400,509 | A | 3/1995 | Collins | |
| 5,435,673 | A | 7/1995 | Rangel | |
| 5,437,101 | A | 8/1995 | Collins | |
| 5,450,670 | A | 9/1995 | Sakai | |
| 5,463,798 | A | 11/1995 | Wurzer | |
| D365,266 | S | 12/1995 | Hasegawa | |
| 5,495,673 | A | 3/1996 | Gardiner et al. | |
| 5,502,895 | A | 4/1996 | Lemaire | |
| 5,511,310 | A | 4/1996 | Sessions et al. | |
| 5,515,610 | A | 5/1996 | Levin et al. | |
| 5,537,750 | A | 7/1996 | Seber et al. | |
| 5,553,340 | A * | 9/1996 | Brown, Jr. | 7/118 |
| 5,588,340 | A | 12/1996 | Hancock | |
| 5,594,966 | A | 1/1997 | Goldman | |
| 5,628,117 | A | 5/1997 | Glesser | |
| 5,653,525 | A | 8/1997 | Park | |
| 5,689,885 | A | 11/1997 | Walston | |
| 5,692,304 | A | 12/1997 | Campbell | |
| 5,697,114 | A | 12/1997 | McIntosh et al. | |
| 5,737,841 | A | 4/1998 | McHenry et al. | |
| 5,745,997 | A | 5/1998 | Berg et al. | |
| 5,755,035 | A | 5/1998 | Weatherly | |
| 5,765,247 | A | 6/1998 | Seber et al. | |
| 5,781,950 | A | 7/1998 | Swinden et al. | |
| 5,802,722 | A | 9/1998 | Maxey et al. | |
| 5,809,600 | A | 9/1998 | Cachot | |
| 5,815,927 | A | 10/1998 | Collins | |
| 5,822,867 | A | 10/1998 | Sakai | |
| 5,826,340 | A | 10/1998 | Hull | |
| D405,676 | S | 2/1999 | Rivera | |
| 5,887,347 | A | 3/1999 | Gibbs | |
| 5,896,665 | A | 4/1999 | Harris | |
| 5,928,069 | A | 7/1999 | Glesser | |
| 5,964,036 | A | 10/1999 | Centofante | |
| 5,979,059 | A | 11/1999 | Leatherman et al. | |
| 5,983,686 | A | 11/1999 | Lee | |
| 6,006,385 | A | 12/1999 | Kershaw et al. | |
| 6,014,787 | A | 1/2000 | Rivera | |
| 6,038,735 | A | 3/2000 | Chang | |
| 6,079,106 | A | 6/2000 | Vallotton | |
| 6,101,724 | A | 8/2000 | Halligan | |
| 6,105,255 | A | 8/2000 | Cheng | |
| 6,112,352 | A | 9/2000 | Legg | |
| 6,145,202 | A | 11/2000 | Onion | |
| 6,145,851 | A | 11/2000 | Heber | |
| 6,170,104 | B1 | 1/2001 | Seber et al. | |
| 6,223,372 | B1 | 5/2001 | Barber | |
| 6,233,769 | B1 | 5/2001 | Seber et al. | |
| 6,256,887 | B1 | 7/2001 | Osborne | |
| 6,282,997 | B1 | 9/2001 | Frazer | |
| 6,286,397 | B1 | 9/2001 | Taggart et al. | |
| 6,308,420 | B1 | 10/2001 | Moser | |
| 6,341,423 | B1 | 1/2002 | Taggart et al. | |
| 6,360,443 | B1 | 3/2002 | Remus | |
| 6,371,841 | B1 | 4/2002 | Ray | |
| 6,389,625 | B1 | 5/2002 | Rivera | |
| 6,397,476 | B1 | 6/2002 | Onion | |
| 6,397,477 | B1 | 6/2002 | Collins | |
| D461,386 | S | 8/2002 | Ray | |
| 6,438,848 | B1 | 8/2002 | McHenry et al. | |
| 6,438,849 | B1 | 8/2002 | Wonderley | |
| 6,442,843 | B1 | 9/2002 | Jue et al. | |
| 6,490,797 | B1 | 12/2002 | Lake et al. | |
| D474,095 | S | 5/2003 | Luquire | |
| 6,574,869 | B1 | 6/2003 | McHenry et al. | |
| 6,591,504 | B2 | 7/2003 | Onion | |
| 6,594,906 | B1 | 7/2003 | Sakai et al. | |
| 6,618,946 | B2 | 9/2003 | Seraphin | |
| 6,618,947 | B1 | 9/2003 | Gardiner et al. | |
| 6,622,327 | B1 | 9/2003 | Rivera | |
| 6,622,328 | B2 | 9/2003 | Rivera | |
| D480,492 | S | 10/2003 | Wu | |
| 6,651,344 | B2 | 11/2003 | Cheng | |
| 6,560,873 | B1 | 12/2003 | Ortner et al. | |
| D484,770 | S | 1/2004 | Green | |
| 6,675,419 | B2 | 1/2004 | Rivera | |
| 6,684,510 | B1 | 2/2004 | Collins | |
| 6,711,820 | B2 | 3/2004 | Chen | |
| 6,729,028 | B1 * | 5/2004 | Hsu | 7/118 |
| 2001/0016987 | A1 | 8/2001 | Chen | |
| 2002/0007099 | A1 | 1/2002 | Anciaux et al. | |
| 2002/0029426 | A1 | 3/2002 | Seber et al. | |
| 2002/0037256 | A1 | 3/2002 | Nocerino et al. | |
| 2002/0095792 | A1 | 7/2002 | Jue et al. | |
| 2002/0123535 | A1 | 9/2002 | Araullo-McAdams et al. | |
| 2002/0155270 | A1 | 10/2002 | Chaudhary et al. | |
| 2002/0189976 | A1 | 12/2002 | Wilde et al. | |
| 2003/0109759 | A1 | 6/2003 | Anciaux et al. | |

| | | | |
|---|---|---|---|
| 2004/0006149 | A1 | 1/2004 | Handa et al. |
| 2004/0020057 | A1 | 2/2004 | Hughes |
| 2004/0020058 | A1 | 2/2004 | Vallotton |
| 2004/0021243 | A1 | 2/2004 | Shih et al. |
| 2004/0064953 | A1 | 4/2004 | Cheng |
| 2004/0078981 | A1 | 4/2004 | Cheng |
| 2004/0082465 | A1 | 4/2004 | Kiso et al. |
| 2004/0088865 | A1 | 5/2004 | Onion |
| 2004/0127383 | A1 | 7/2004 | Pham et al. |
| 2004/0249078 | A1 | 12/2004 | Bogdan et al. |
| 2005/0004409 | A1 | 1/2005 | Pennetreau et al. |
| 2005/0107647 | A1 | 5/2005 | Anciaux et al. |
| 2005/0113470 | A1 | 5/2005 | Zhu et al. |
| 2005/0131090 | A1 | 6/2005 | Furlan et al. |
| 2005/0222285 | A1 | 10/2005 | Massengill et al. |
| 2005/0222289 | A1 | 10/2005 | Miller |
| 2005/0233923 | A1 | 10/2005 | Singh et al. |
| 2005/0233933 | A1 | 10/2005 | Singh et al. |
| 2005/0245629 | A1 | 11/2005 | Grigsby, Jr. et al. |

FOREIGN PATENT DOCUMENTS

| | | | |
|---|---|---|---|
| EP | 0 600 823 | | 6/1994 |
| EP | 0 714 736 | A1 | 6/1996 |
| EP | 0 771 622 | A1 | 5/1997 |
| EP | 0 783 937 | A2 | 7/1997 |
| EP | 1 023 971 | A2 | 8/2000 |
| EP | 1 116 557 | A2 | 7/2001 |
| EP | 1 340 597 | A2 | 9/2003 |
| EP | 1 733 854 | | 12/2006 |
| FR | 2 655 635 | A1 | 6/1991 |
| FR | 2 760 955 | A1 | 9/1998 |
| GB | 2 190 321 | A | 11/1987 |
| WO | WO 87/06102 | | 10/1987 |
| WO | WO 97/19787 | A1 | 6/1997 |
| WO | WO 98/18599 | A1 | 5/1998 |

OTHER PUBLICATIONS

Delta Folding Knife—EW-04 available from SureFire, available at http://www.surefire.com/maxexp/main/co_disp/displ/carfnbr/317/prrfnbr/24381 (Jul. 5, 2006), 1 page.

Cord/Harness Cutter, available at http://www.surefire.com/surefire/content/ew04_large.jpg, (Jul. 5, 2006), 1 page.

Swiss+Tech Products, available at http://www.swisstechtools.com/productdetail.aspx?PID=pHL7RxHb%2frwA, (Jul. 5, 2006), 1 page.

Serengeti Hunter, available at http://www.crkt.com/serenget.html, (Jul. 5, 2006), 2 pages.

Search Report for corresponding European Application No. EP 07 10 5090 completed Sep. 27, 2007.

* cited by examiner

HAND TOOL

FIELD OF THE INVENTION

Embodiments of the present invention relate generally to hand tools and more particularly, to hand tools having both rotatable and slideable implements as well as hand tools that are adapted to carry a sharpening tool.

BACKGROUND OF THE INVENTION

A variety of hand tools have been developed. These hand tools can have a number of different implements depending upon the purpose and desired functionality of the hand tool. The hand tools can include implements that are fixed as well as implements that are actuable or moveable in some manner. With respect to hand tools having implements that are actuable or moveable, the implements can be configured to move in different manners relative to the handle, such as by rotating or folding relative to the handle or by sliding inwardly and outwardly relative to the handle.

Hand tools that include implements that move relative to the handle may be advantageous in that such hand tools can include a number of different implements in a relatively compact package. For example, a pocket knife may include two or more blades that are carried inside a handle for storage and are capable of being selectively opened. In addition to knife blades, folding hand tools can include a variety of other implements, such as a screw driver, an awl, a bottle opener, a can opener, saw, file, etc., in order to add to the versatility and utility of the tools. In addition to implements that fold or rotate relative to the handle, any one or all of the foregoing implements can be designed to slide inwardly and outwardly relative to the handle if so desired.

While hand tools having implements that are adapted to move relative to handle are relatively compact in relation to at least some comparable hand tools in which the implements are fixed, hand tools having implements that fold or slide can still sometimes be bulkier than desired. In this regard, each implement is generally positioned in a side-by-side configuration such that the thickness or width of the hand tool increases with each additional implement. For example, a pocket knife may include a first folding implement adjacent a first side of the handle, a second folding implement adjacent an opposed second side of the handle, and a number of other folding implements positioned side-by-side between the first and second implements. If a hand tool includes implements that slide instead of fold relative to the handle, these sliding implements are also typically positioned in a side-by-side or laterally offset arrangement so as to similarly add to the thickness or width of the hand tool. Thus, it would be desirable to reduce the thickness or width of hand tools while still including the same number and type of implements in order not to unduly limit the versatility of the hand tool.

Hand tools commonly include implements that have cutting edges. For example, knife blades and cutting hooks both have cutting edges. In order to maintain the desired performance of these implements over time, the cutting edges must be sharpened following repeated use of the respective implements. As such, a sharpening tool, such as a honing rod or stone is commonly carried in addition to the hand tool. Thus, when it is believed that a cutting edge is duller than is desired, the sharpening tool is located and the cutting edge is sharpened. Unfortunately, a user of a hand tool is therefore required to carry not only the hand tool, but also a separate sharpening tool, thereby adding to the number of different items with which the user must keep track. In this regard, as the sharpening tool is used only intermittently, the sharpening tool can be misplaced between uses such that the user is forced to expend an inordinate amount of time attempting to locate the sharpening tool. In instances in which the user is in a remote location, such as in the woods or on a lake, the user may be unable to sharpen a dull cutting edge when desired if the user cannot locate the sharpening tool. Thus, it would be desirable to ensure that sharpening tools were more readily accessible to the user of a hand tool.

BRIEF SUMMARY OF THE INVENTION

According to one embodiment, hand tools are provided that include a first, rotatable implement and a second, slideable implement in which a predefined axis along which the second, slideable implement moves and lies within a predetermined plane through which the first rotatable implement rotates. As a result, the hand tool of this embodiment can include first and second implements that need not be positioned in a side-by-side manner, but can, instead, be positioned more compactly so as to move within a common plane. In another embodiment, a hand tool is provided having a handle, at least one implement having a cutting edge, and a sharpening tool carried by the handle and configured to sharpen the cutting edge of the implement. As a result, a user of the hand tool of this embodiment need not carry a separate sharpening tool, since the sharpening tool is already carried by the handle of the hand tool so as to be available upon demand.

In one embodiment, a hand tool includes the handle, a first implement, such as a knife blade, rotatably connected to the handle and a second implement, such as a cutting hook, slideably connected to the handle. The first implement is configured to move through and define a predetermined plane during rotation of the first implement relative to the handle. Similarly, the second implement is configured to move along a predefined axis during the slideable extension of the second implement relative to the handle. As noted above, the first and second implements are further configured such that the predefined axis along which the second implement moves lies within the predetermined plane through which the first implement moves.

The second implement may be configured to slide between first and second positions with the second implement being at least partially disposed within the handle in the first position, but extending outwardly from the handle in the second position. Additionally, the first implement may be configured to rotate between first and second positions with the first implement being at least partially disposed within the handle in the first position, but extending outwardly from the handle in the second position. In one embodiment, the first and second implements are configured to extend outwardly from the handle in opposite directions in their respective second positions.

The hand tool may also include a catch disposed within the handle and configured to engage the second implement in the first and second positions. In this regard, the second implement may define first and second recesses with the catch engaging the first and second recesses in the first and second positions, respectively.

In another embodiment, the hand tool includes a handle and at least one implement connected to and configured to extend outwardly from the handle. The implement includes a cutting edge. The hand tool of this embodiment also includes a sharpening tool carried by the handle and configured to sharpen the cutting edge of the implement.

In respect to the manner in which the sharpening tool is carried by the handle, the handle can define a recess for receiving the sharpening tool. In this regard, the recess defined by the handle may be configured to frictionally engage the sharpening tool. In one embodiment, the sharpening tool includes a honing rod with the recess defined by the handle including a groove for receiving the honing rod. The groove may open toward one end of the handle to permit the honing rod to be slideably inserted and removed from the groove.

In addition to the honing rod, the sharpening tool can include a sleeve for covering the honing rod. Additionally, the sharpening tool can include a handle at one end of the honing rod. The handle, in turn, may include an engagement feature extending outwardly therefrom for frictionally engaging the recess defined by the handle.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5:
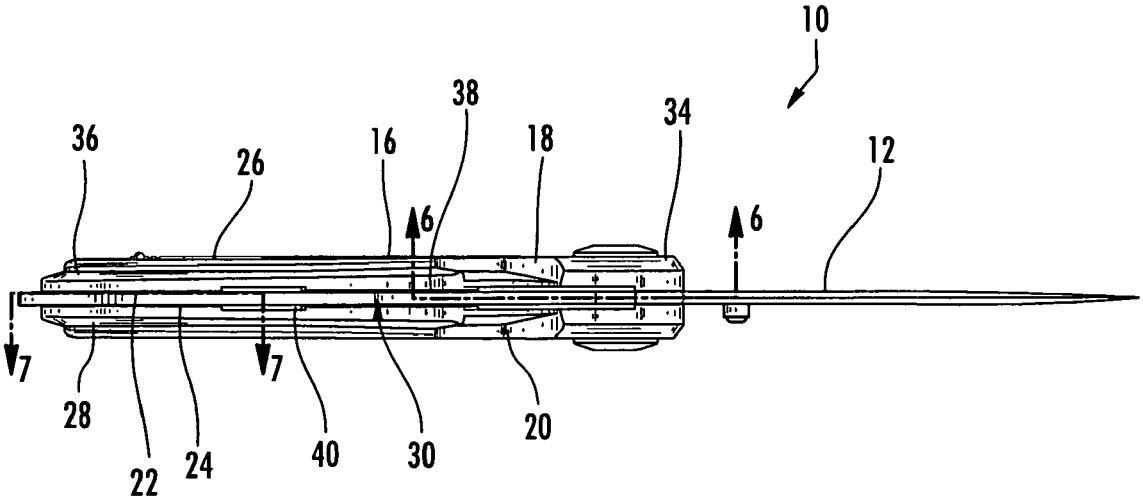
FIG. 5 is a bottom view of the hand tool of FIG. 1, wherein the first implement is in the extended position and the second implement is in the retracted view.
Figure 6A:
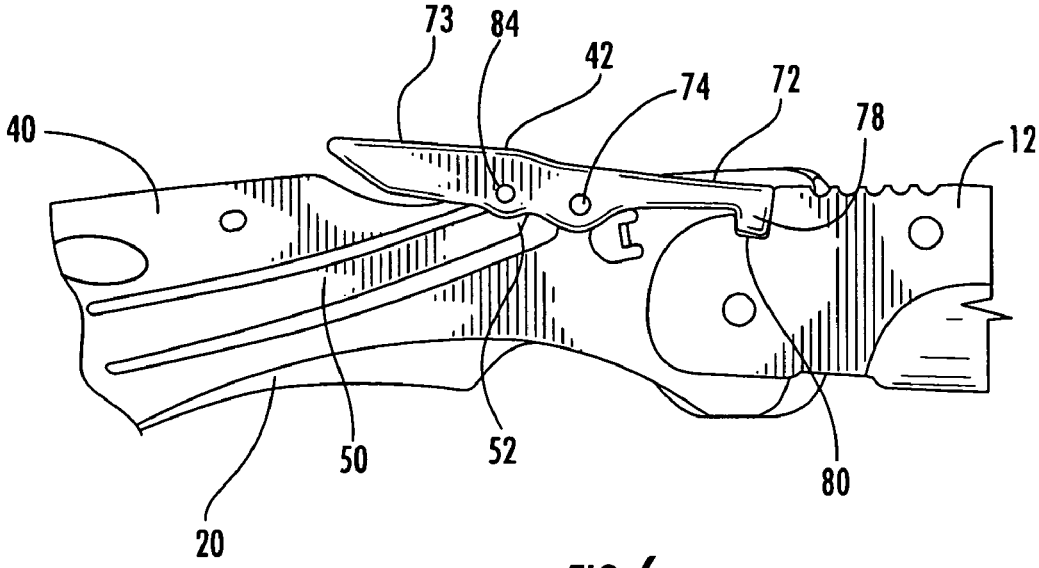
Figure 6B:
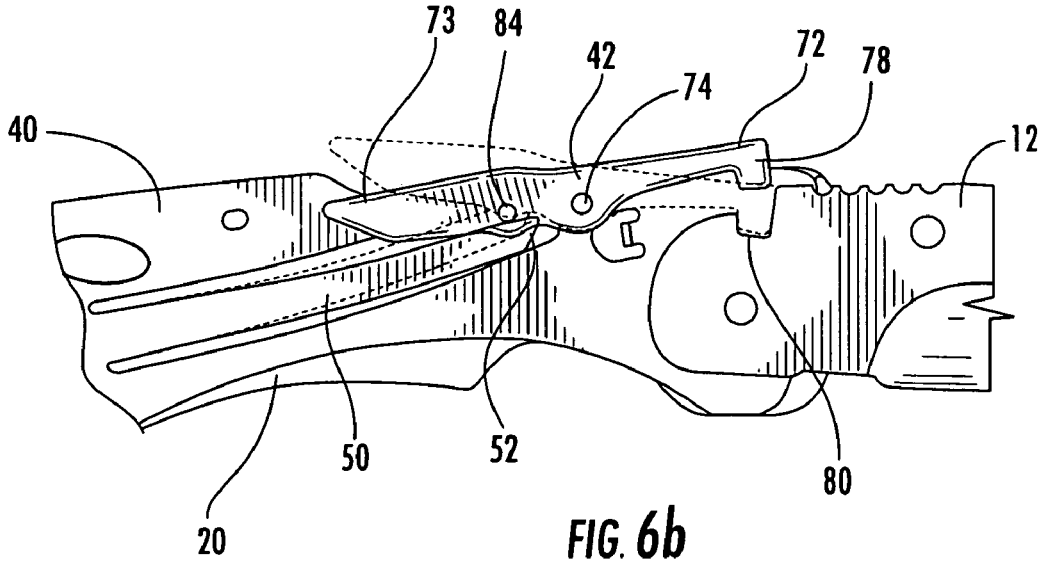
Figure 7A:
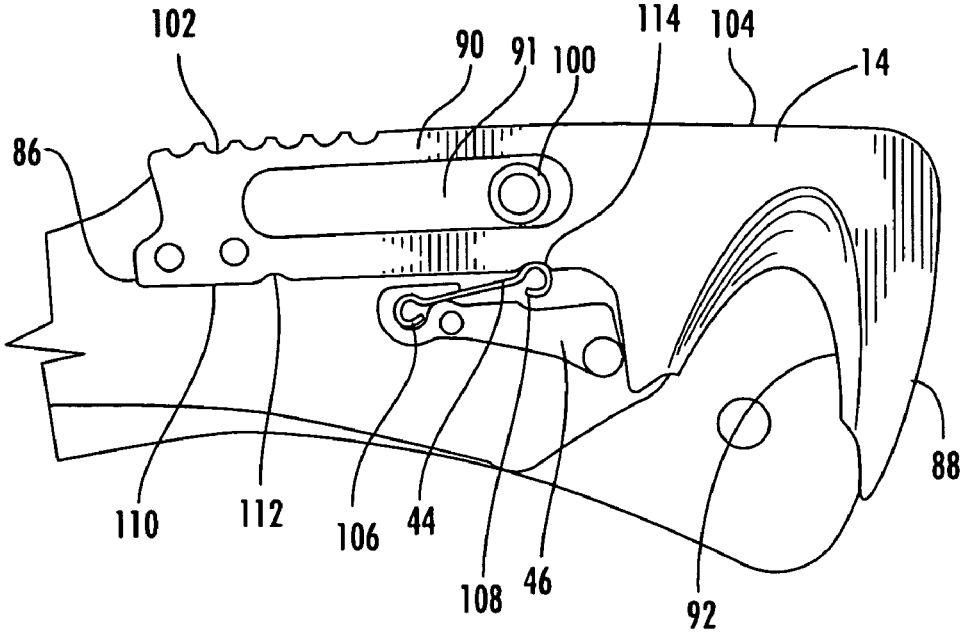
Figure 7B:
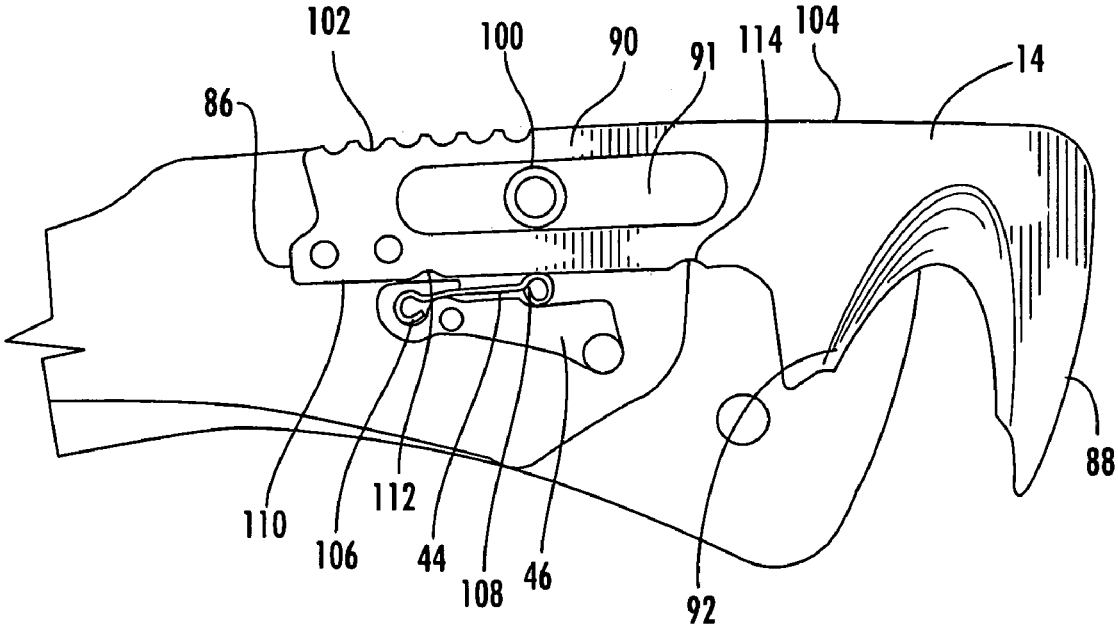

FIG. 6*a* is a partial cut-out view of the hand tool of FIG. 5 taken along line 6-6, wherein the locking member is in a locked position;

FIG. 6*b* is a partial cut-out view of the hand tool of FIG. 5 taken along line 6-6, wherein the locking member is in a released position;

FIG. 7*a* is a partial cut-out view of the hand tool of FIG. 5 taken along line 7-7, wherein the second implement is in a retracted position;

FIG. 7*b* is a partial cut-out view of the hand tool of FIG. 5 taken along line 7-7, wherein the second implement is moved out of the retracted position shown in FIG. 7*a;*

Figure 1:
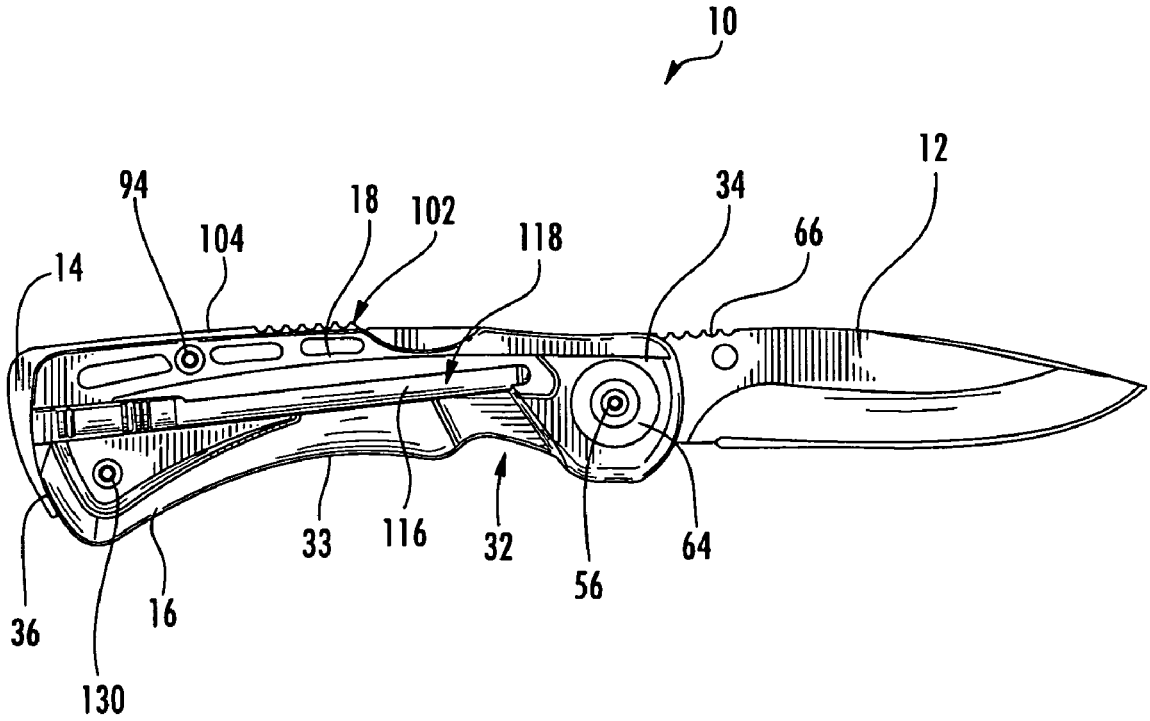
FIG. 1 is a front view of a hand tool according to an embodiment of the present invention, wherein a first implement is in an extended position and a second implement is in a retracted position.
Figure 8:
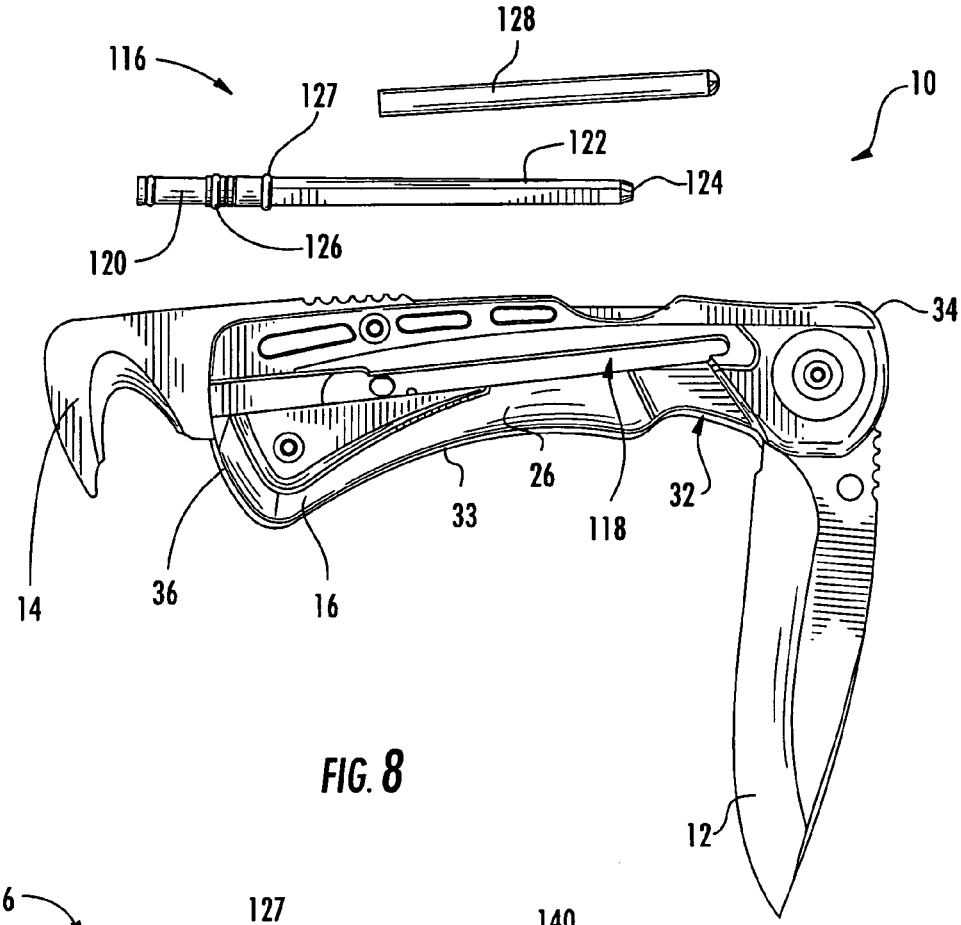
Figure 9A:
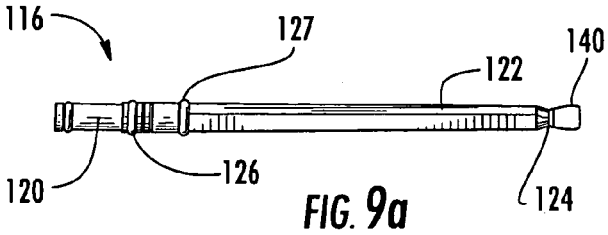
Figure 9B:
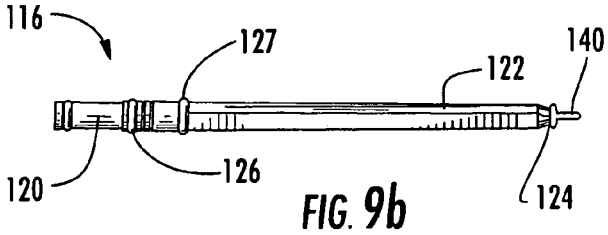

FIG. 8 is an angled front view of the hand tool of FIG. 1, wherein the sharpening tool is removed from the handle and the sleeve is removed from the honing rod;

FIG. 9*a* is a side view of a sharpening tool according to another embodiment of the present invention; and FIG. 9*b* is a side view of a sharpening tool according to yet another embodiment of the present invention.

DETAILED DESCRIPTION OF THE INVENTION

The present invention now will be described more fully hereinafter with reference to the accompanying drawings in which some but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 2:
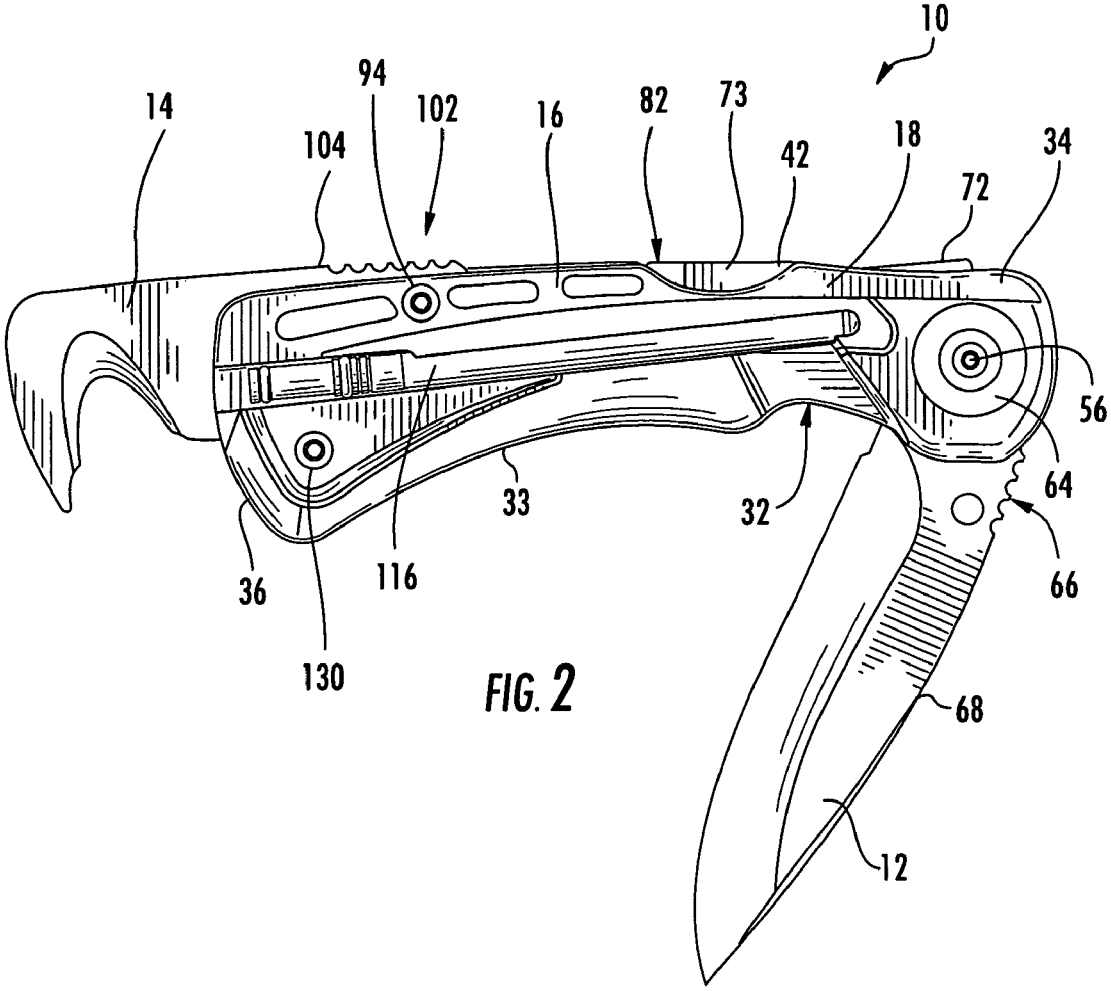
FIG. 2 is another front view of the hand tool of FIG. 1, wherein the second implement is in an extended position and the first implement is an intermediate position between the extended position and a retracted position.
Figure 3:
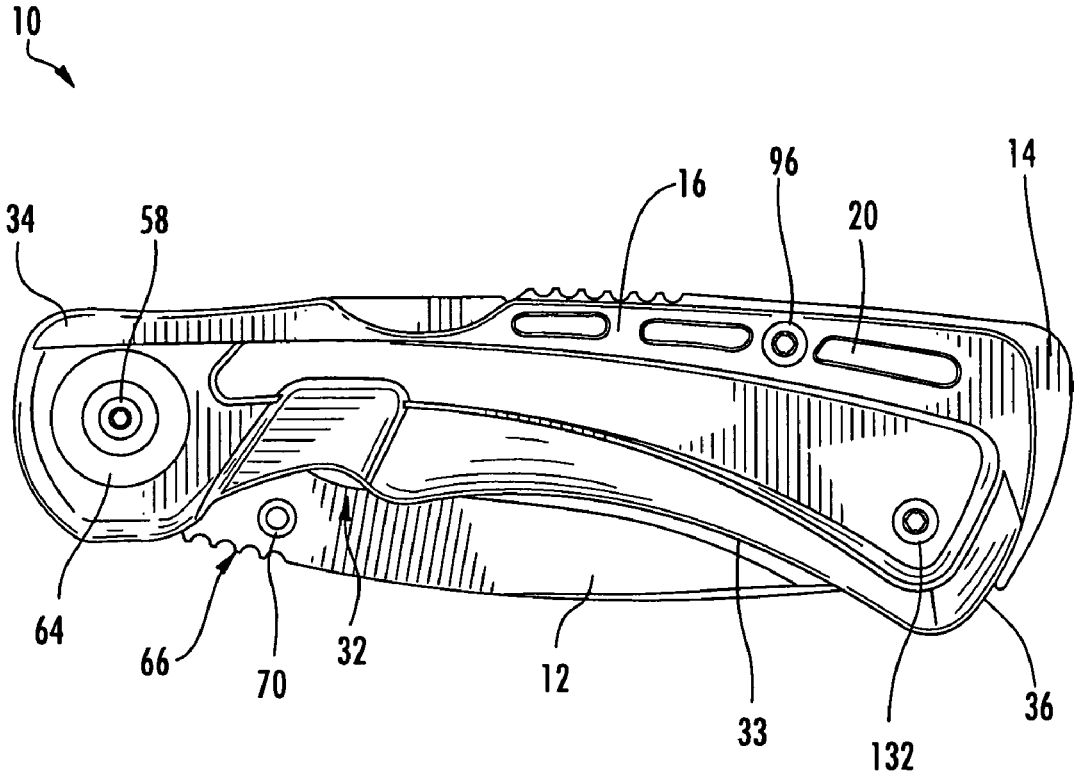
FIG. 3 is a back view of the hand tool of FIG. 1, wherein the first and second implements are in retracted positions.

Embodiments of the present invention provide a hand tool that includes a handle and one or more implements. An implement, as used herein, may include a wide variety of tools or blades, including, but not limited to straight or curved knife blades, serrated blades, cutting hooks, screw drivers, awls, bottle openers, can openers, saws, files, or razors. For example purposes only and as shown in FIG. 2, the hand tool 10 may have a first implement 12 that is a knife blade and a second implement 14 that is a cutting hook, such as a gut hook. Furthermore, as further discussed below, each implement may be movable or fixed relative to the handle. For example purposes only and as shown in FIGS. 1 through 3, the first implement 12 may be rotatable about the handle 16 and the second implement 14 may be slideable relative to the handle 16.

In general, the handle 16 is sized and shaped so as to be readily grasped by a user. The handle 16 may include a first scale, referred to herein for descriptive purposes only as the front scale 18, and a second scale, referred to herein for descriptive purposes only as the back scale 20. As best seen in FIG. 5, each scale 18, 20 includes an inner facing side 22, 24 and an outer facing side 26, 28. The front scale 18 and the back scale 20 are spaced apart by one or more spacers and/or fasteners that are disposed between and/or extend inwardly from one or both of the scales 18, 20. The scales may be made from a variety of materials including metal, wood or plastic. For example, the scales may be made from a hardened plastic such as glass-filled nylon.

The outer facing sides of the scales may define a number of aesthetic or functional features. In the illustrated embodiment, for example, the scales 18, 20 define a notch 32 positioned to receive the index finger of the user as well as a smoothly curved portion 33 extending generally rearwardly from the notch 32 for permitting the other fingers of the user to wrap thereabout. The outer facing sides 26, 28 may also include one or more raised and/or angled surfaces for aesthetics or functional purposes. In yet another example, the outer facing sides may also include textured or non-stick coated surfaces to help strengthen a user's grip of the handle.

The area between the inner facing sides 22, 24 of the scales generally define an interior cavity 30 of the handle 16. The interior cavity 30 may be shaped and dimensioned for receiving at least a portion of one or more of the implements 12, 14. For example, as shown in the illustrated embodiment, the first implement 12 may be rotatably connected between the front and back scales 18, 20 proximate to a first end 34 of the handle. The first implement 12 may rotate in a predetermined plane from a first position, referred to herein for descriptive purposes only as the extended position, to a second position, referred to herein for descriptive purposes only as the retracted position. As shown in FIGS. 1 and 5, in the extended position, the first implement 12 generally extends outwardly from the first end 34 of the handle along the length of the hand tool, such that substantially all or most of the first implement 12 is outside the handle 16. As shown in FIG. 3, in the retracted position, the first implement 12 extends inwardly from the first end 34 of the handle toward the second and opposite end 36 of the handle such that at least the cutting or working edge of the first implement 12 is within the interior 30 of the handle 16.

Also, as shown in the illustrated embodiment, the second implement 14 may be slidably connected between the front and back scales 18, 20. The second implement 14 may slide along a predetermined axis between a first position, referred to herein for descriptive purposes only as the extended position, and a second position, referred to herein for descriptive purposes only as the retracted position. As shown in FIGS. 1 and 2, a greater portion of the second implement 14 is disposed outside the handle 16 when in the extended position compared to when the second implement is in the retracted position. Although the alignment may vary between the first and second implements 12, 14, according to the illustrated embodiment the predetermined axis in which the second implement moves along lies in the predetermined plane in which the first implement rotates within. By lying within the same plane, the hand tool may be constructed in a more compact manner than if the implements were laterally displaced from one another or otherwise positioned in a side-by-side manner.

Figure 4:
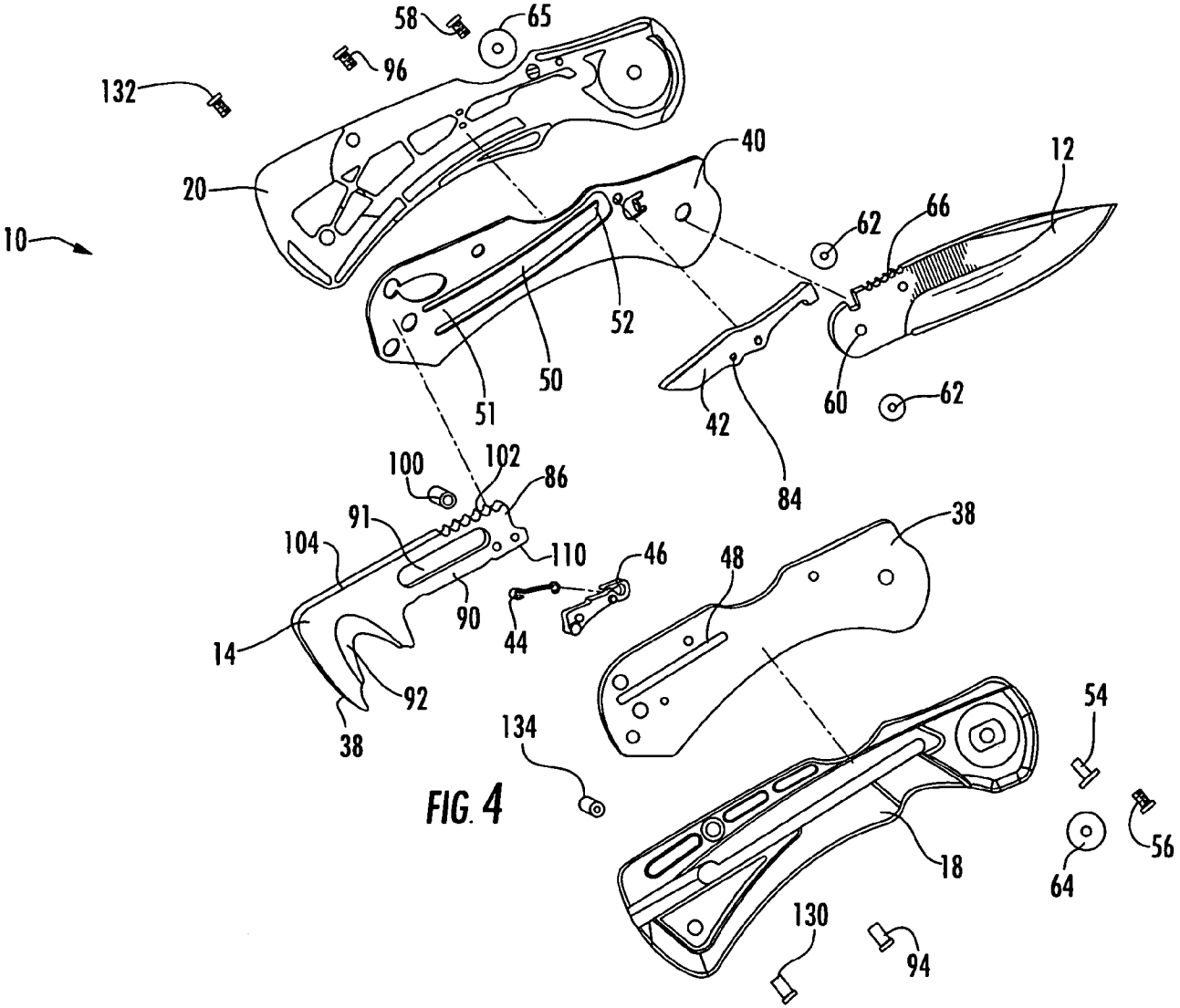
FIG. 4 is an exploded view of the hand tool of FIG. 1.

The implements may be connected to and supported by the handle by a variety of mechanisms or configurations. For example, according to the illustrated embodiment and as best seen in FIG. 4, the hand tool 10 further includes a first plate 38, a second plate 40, a locking lever 42, a first spring arm 44, a spring support 46 and a plurality of spacers, washers, and fasteners. The first and second plates are referred to herein for descriptive purposes only as front and back plates 38, 40 respectively.

As best seen in FIG. 5, the front plate 38 is adjacent the inner facing side 22 of the front scale. More specifically, the inner facing side 22 of the front scale may define a recessed area for receiving the front plate 38. The front plate 38 defines a number of apertures for receiving pins extending from other components and fasteners used to hold the front and back scales together. As seen in FIG. 4, the front plate also defines a first slot 48 that generally extends lengthwise relative to the handle 16.

The back plate 40 is adjacent the inner facing side 24 of the back scale. More specifically, the inner facing side 24 of the back scale may define a recessed area for receiving the back plate 40. The back plate 40 defines a number of apertures for receiving pins extending from other components and fasteners used to hold the front and back scales together. The back plate also defines an opening through which a second spring arm 50 extends. The second spring arm 50 extends from a supported end 51 to a distal and unsupported end 52.

The plates may be made from a variety of materials and methods. For example, the plates may be made from metal through a stamping process. In the illustrated embodiment, the plates are held in place by the recessed areas, fasteners, and the other components. The plates may also be attached to the scales by an adhesive or by other means.

The first implement 12 may be rotatably supported between the plates 38, 40 near the first end 34 of the handle. For example, the hand tool 10 may include a first spacer 54, a first fastener 56, a second fastener 58, first washer 64, and a second washer 65. The first spacer 54 may define a threaded interior surface and an outer cylindrical surface. The first spacer supports the first implement 12, such that the first implement 12 is rotatable about the first spacer 54 between the retracted and extended positions within a predetermined plane. More specifically, the first spacer 54 extends through the front scale 18 and the front plate 38 and through an aperture 60 defined in the first implement 12 to the back plate 40. The first fastener 56 extends through the first washer 64 and engages the threaded interior surface of the first spacer 54. The second fastener 58 extends through the second washer 65, the back scale 20 and the back plate 40 and engages the threaded interior surface of the first spacer 54.

The hand tool 10 may include another pair of washers 62 between the first implement 12 and the plates 38, 40 to increase the bearing surfaces of the first implement and help protect the surfaces of the first implement and the plates as the first implement rotates. For example, the washers may be formed of a plastic with low surface resistance.

As best seen in FIG. 2, the first implement 12 may also include a serrated portion 66 on a non-cutting edge 68 and/or a thumb stud 70 extending from a side of the first implement 12 to facilitate the handling of the first implement 12 between the retracted and extended positions.

The first implement 12 may also be lockable in one or both positions. For example, in the illustrated embodiment and as shown in FIGS. 6*a* and 6*b*, the locking lever 42 is configured to lock the first implement 12 in the extended position. More specifically, the locking lever 42 of the illustrated embodiment extends from a first end 72 to a second end 73 and is pivotally supported between the front and back plates. The locking lever 42 includes a pair of pins 74 extending outwardly near the middle portion of the lever 42. The pins 74 engage apertures defined in the front and back plates such that the lever is pivotally supported about the pins. The locking lever 42 may move between a first position, illustrated in FIG. 6*a* and referred to herein for descriptive purposes only as a locked position, and a second position, illustrated in FIG. 6*b* referred to herein for descriptive purposes only as a released position. The first end 72 of the lever includes a downward projecting extension 78. In the locked position and when the first implement is in the extended position, the downward projecting extension 78 of the lever is positioned to engage a notch 80 defined in the first implement. Once the downward projecting extension 78 and the notch 80 are engaged, the first implement 12 is inhibited from moving and thus is locked into the extended position. In the released position, the downward projecting extension 78 of the lever is positioned above and out of the notch 80 such that the locking lever 42 does not interfere with the rotation of the first implement 12.

The locking lever 42 may be moved between the locked and released positions by engaging the second end 73 of the lever. The lever 42 may be accessible to a user through another notch 82 defined by the top outer edges of the front and back scales 18, 20, as best seen in FIG. 2. Specifically, the lever 42 may be moved to the released position by the operator depressing the second end 73 inwardly toward the handle 16. The lever 42 may be biased to the locked position, such that the after the operator releases the second end 73 the lever may return to the locked position. For example, the lever 42 may include a protusion extending toward the back cover 40 near the middle section of the lever 42. The protusion is positioned above the unsupported end 52 of the second spring arm 50. When the second end 73 of the lever is depressed, the protusion 84 engages the second spring arm 50 and moves the second spring arm from a rest position to a spring position, as shown in FIGS. 6*a* and 6*b*. The operator's depression of the second end of the lever initially overcomes the resistance of the spring arm to move out of the rest position and into the spring position. The continual depression of the second end by the operator overcomes the bias in the spring arm to move back to the rest position. Once the operator releases the second end 73 of the lever, the force provided by the second spring arm 50 urges the protusion 84 and the lever 42 to the locked position. One in the art should appreciate that the locking lever as described above is only one example of the various locking levers and devices that may be used to lock or bias the first implement into one or both retracted or extended positions.

The second implement 14 may be slideably supported between the plates 38, 40 and/or scales 18, 20 opposite the first implement 12 along a predetermined axis. For example according to the illustrated embodiment of FIGS. 7*a* and 7*b*, the second implement 14 extends from a first end, referred to herein for descriptive purposes only as the handle end 86, and a second end, referred to herein for descriptive purposes only as the tool end 88. More specifically, the second implement 14 includes a stem 90 extending from the handle end 86 toward the working end 88 and a tool head 92 extending from the stem 90 to the working end 88.

The stem 90 defines a second slot 91 that extends along the length of the stem 90 and the length handle 16. The hand tool 10 may further include a third fastener 94 and fourth fastener 96. The third fastener 94 may include head and a spacer end that defines an outer cylindrical surface and an interior threaded surface. The fourth fastener 96 may include a head and a threaded portion. The third fastener 94 may extend through the front scale 18, front plate 38, and the second slot 91 defined by the stem to the back plate 40. The fourth fastener 96 may extend through the back scale 20, back plate 40, and engage the interior threaded surface of the third fastener 94. The stem 90 may also include a pin that corresponds with the first slot 48 defined by the front plate 38 such that the pin slides along the first slot 48 when the second implement 14 is sliding. The scales 18, 20, plates 38, 40, the pin and first slot 48, and the second slot 91 and the spacer end of the third fastener 94 facilitate the sliding of the second implement 14 along the length of the handle 16. The hand tool 10 may also include another spacer 100 that extends between the plates 38, 40 and is contained within the second slot 91 to further facilitate the sliding of the second implement 14. For example, the third and fourth fasteners 94, 96 may extend through the spacer 100 such that the spacer remains substantially stationary as the second implement 14 slides The second implement 14 may also include a serrated portion 102 on an outer edge 104 to help urge the second implement 14 outward or inward during movement. The outer edge 104 extends beyond the handle 16 to allow the outer edge 104 including the serrated portion 102 to be accessible to the operator when the second implement 14 is in the retracted position, as seen in FIG. 1, such that the operator can utilize the serrated portion 102 to apply the necessary force to extend or deploy the second implement.

The hand tool 10 may further have one or more catches to encourage the second implement to remain in one or more of the extracted or retracted positions. For example, according to the illustrated embodiment, the hand tool includes the first spring arm 44 and the spring support 46. The spring support 46 is connected between the two plates 38, 40 by one or more pins on both ends, such that the spring support 46 is inhibited from moving relative to the plates 38, 40. As shown in FIGS. 7*a* and 7*b*, the first spring arm 44 extends from a first supported end 106 that is attached to the spring support 46 to a second unsupported end 108. The stem 90 of the second implement may include an inner edge 110 that defines at least a first inner recess 112 and a second outer recess 114. The second unsupported end 108 may be positioned to engage the recesses 112, 114 of the inner edge 110. More specifically, when the second implement 14 is in the extended position, the second end 108 of the first spring arm may engage the first inner recess 112 of the inner edge 110, such that the engagement creates a certain resistance to any further movement of the second implement 14. An operator may overcome this resistance by pushing or pulling the second implement 14 inward toward the handle. When the resistance is overcame, the spring's second end 108 is moved out of the first inner recess 112 and is deflected downward by the inner edge 110 as it slides over the spring's second end 108, as shown in FIG. 7*b*. Once the second outer recess 114 lines up with the spring's second end 108, the bias in the first spring arm 44 will encourage the spring's second end 108 into the second outer recess 114 and thus catch the second implement 14, as shown in FIG. 7*a*. The second outer recess 114 may be positioned such that the second outer recess 114 lines up with the spring's second end 108, when the second implement 14 is in the retracted position. Similarly, to slide the implement back into the extended position from the retracted position, the operator overcomes the resistance created by the spring's second end by pushing or pulling the second implement away from the handle such that the second outer recess disengages from the spring's second end and the second implement slides out until the first inner recess lines up with the spring's second end. One in the art should appreciate that the catch as described above is only one example of the various configurations and structures that may be used to catch or even lock the second implement into one or both retracted or extending positions.

The front and back scales of the handle may further be connected to each other by a third set of fasteners near the second end 36 of the handle. For example, the hand tool 10 may further include a fifth fastener 130, a sixth fastener 132, and a third spacer 134. The third spacer 134 generally extends from the front scale 18 to the back scale 20. The third spacer defines an interior threaded surface and a cylindrical outer surface. The fifth fastener 130 extends through the front scale 18 and engages the interior threaded surface of the third spacer 134. Similarly, the sixth fastener 132 extends through the back scale 20 and engages the interior threaded surface of the third spacer 134.

In the illustrated embodiment, the third spacer 134 may function as a stop for the first implement 12 when the first implement is rotated into the retracted position. The cylindrical outer surface of the third spacer 134 may be lined or coated with a shock absorbing material, such as rubber, in order to help protect the edge of first implement 12 when it contacts the third spacer 134.

As stated above the hand tool may include additional implements that are fixed, rotatable, or slideable relative to the handle. Furthermore, the hand tool may include one or more instruments. In general as used herein an implement is a tool or blade that is configured to remain attached to the handle during operations, while an instrument is a tool or blade that is configured to be removed from the handle of the hand tool during operations. For example and not as a limitation, the instrument or instruments may be a sharpening tool, a screwdriver, a wrench, or tweezers.

According to the illustrated embodiment and as best seen in FIGS. 2 and 8, the hand tool 10 includes and integrally carries a sharpening tool 116. The outer facing side 26 of the front scale defines a recess, such as a groove 118, for receiving the sharpening tool 116. In the illustrated embodiment, the sharpening tool 116 may be slid into the groove 118 from an end 36 of the hand tool along the length of the hand tool. The groove may be shaped to cause a frictional engagement or interference fit such that an operator may slide the sharpening tool in and out of the groove with a predetermined force. However, the force required to overcome the interference fit minimizes the likelihood that the sharpening tool will inadvertently escape from the groove.

Instead, the operator will have to affirmatively remove the sharpening tool from the groove.

The location and size of the groove may vary. For example, it may be defined between the plates or by both plates. The groove may also be shaped to only hold a portion of the sharpening tool. Also, instead of sliding the sharpening tool in and out of the groove, the groove and sharpening tool may be adapted for a snap-fit configuration, where the sharpening tool is snapped into the groove from the side of the groove instead of from sliding in from an end of the groove. Also, although described as a groove, the tool handle may have any shaped recessed area for holding or containing the sharpening tool or other instrument.

As best shown in FIG. 8, the sharpening tool 116 may include a handle 120 and a sharpening or honing rod 122 extending from the handle 120 to a distal end 124. The handle 120 may include one or more engagement features 126 such as O-rings or other projections for creating the interference fit with the groove 118 or recessed area. The sharpening tool 116 may also include a sleeve 128 that is adapted to cover the honing rod 122. The sleeve 128 is sized and shaped to generally have clearance about the honing rod 122. While the sleeve 128 may simply be slid over the honing rod 122 without any mechanism for retaining the sleeve in position, the sleeve 128 may be positively engaged by one or more engagement features 127 of the honing rod 122 and/or the handle 120. For example, as shown in the illustrated embodiments, the sleeve 128 may fit snugly onto an o-ring 127 that is on the handle 120. The sleeve helps protect the honing rod during storage and when in use can also be slid over and engages the handle 120 to provide additional gripping surface for the user. Or the sleeve may be retainable by the groove or other area of the handle when the honing rod is in use. The honing rod may be specifically configured to sharpen one or more of the cutting edges of the implements, and may also include specific shapes to sharpen extraneous items such as fish hooks. In this regard and as known to those skilled in the art, the honing rod 122 is generally formed of a material, such as industrial diamond covered steel, knurled steel, etc., that is harder than the material from which the cutting edges are formed such that the honing rod can effectively sharpen the cutting edges. As a result of its integration with the hand tool 10, such as the handle 16 of the hand tool, the sharpening tool 116 of this embodiment of the present invention is readily available wherever and whenever an implement may need to be sharpened with much less risk of being misplaced, forgotten or lost.

As shown in FIGS. 9*a* and 9*b*, the sharpening tool 116 may further include a second instrument 140. For example, the sharpening tool 116 may include a second instrument 140 that extends from the distal end 124 of the honing rod 122. The second instrument 140 may be a variety of tools or blades including picks, awls, or screwdrivers. In some applications, the second instrument 140 may be configured to work with one or more of the implements of the hand tool. For example, the awl may be adapted for cleaning the teeth of a saw blade implement. The second instrument 140 may be fixed to or detachable from the honing rod 122.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hand tool comprising:

a handle;

a first implement rotatably connected to said handle, said first implement configured to move through and define a predetermined plane during rotation of said first implement relative to said handle; and a second implement slidably connected to said handle, said second implement configured to move along a predefined axis during slidable extension of said second implement relative to said handle, a locking member pivotally supported within the handle for locking the first implement into at least one of a first position and a second position of the first implement;

a sharpening tool carried by said handle and configured to sharpen a cutting edge of at least one of the first implement and the second implement; and wherein said first and second implements are further configured such that the predefined axis along which said second implement moves lies within the predetermined plane through which said first implement rotates, and wherein said first implement is configured for movement independent of movement of said second implement.

2. A hand tool according to claim 1 wherein said second implement is configured to slide between first and second positions of the second implement with said second implement being at least partially disposed within said handle in the first position of the second implement and said second implement extending at least partially outwardly from said handle in the second position of the second implement.

3. A hand tool according to claim 2 further comprising a catch disposed within said handle and configured to engage said second implement in the first and second positions of the second implement.

4. A hand tool according to claim 3 wherein said second implement defines first and second recesses, and wherein said catch engages the first and second recesses in the first and second positions of the second implement, respectively.

5. A hand tool according to claim 2 wherein said first implement is configured to rotate between the first and second positions of the first implement with said first implement being at least partially disposed within said handle in the first position of the first implement and said first implement extending outwardly from said handle in the second position of the first implement, and wherein said first and second implements are configured to extend outwardly from said handle in opposite directions in the respective second positions.

6. A hand tool according to claim 1 wherein said first implement comprises a knife blade and said second implement comprises a cutting hook.

7. A hand tool according to claim 1 wherein said handle defines a recess for receiving said sharpening tool.

8. A hand tool according to claim 7 wherein the recess defined by said handle is configured to frictionally engage said sharpening tool.

9. A hand tool according to claim 7 wherein said sharpening tool comprises a honing rod, and wherein the recess defined by said handle comprises a groove for receiving the honing rod.

10. A hand tool according to claim 9 wherein the groove opens toward one end of said handle to permit the honing rod to be slidably inserted and removed from the groove.

11. A hand tool according to claim 9 wherein the honing rod extends from a handle of the sharpening tool to a distal end, and the sharpening tool further includes a second instrument extending from the distal end of the honing rod.

12. A hand tool according to claim 11, wherein the second instrument is selected from the group consisting of an awl, a pick, and a screwdriver.

13. A hand tool comprising:

a handle;

a first implement connected to and configured to extend rotatably from said handle, said first implement having a cutting edge;

a second implement connected to and configured to extend outwardly from said handle; wherein the first implement and the second implement are further configured such that the second implement extends substantially within a plane through which the first implement rotates;

a locking member pivotally supported within the handle for locking the first implement into at least one position and a sharpening tool carried by said handle and configured to sharpen the cutting edge of said first implement; wherein said sharpening tool comprises:

a honing rod; and a sleeve for covering said honing rod; and wherein said handle defines a recess for receiving said sharpening tool.

14. A hand tool according to claim 13 wherein said sharpening tool further comprises a handle at one end of said honing rod.

15. A hand tool according to claim 14, wherein the sleeve covers said honing rod during storage and is retainable by said handle during use of the honing rod.

16. A hand tool according to claim 14 wherein said handle of the sharpening tool comprises an engagement feature extending outwardly therefrom for frictionally engaging the recess defined by said handle of the hand tool.

* * * * *